US010112791B2

(12) United States Patent
Kougami

(10) Patent No.: US 10,112,791 B2
(45) Date of Patent: Oct. 30, 2018

(54) SHEET-CONVEYING DEVICE THAT CONVEYS SHEETS, IMAGE-FORMING APPARATUS USING THE SHEET-CONVEYING DEVICE AND IMAGE-FORMING SYSTEM THAT USES THE SHEET-CONVEYING DEVICE

(71) Applicant: Konica Minolta, Inc., Chiyoda-ku, Tokyo (JP)

(72) Inventor: Masashi Kougami, Saitama-ken (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/802,570

(22) Filed: Jul. 17, 2015

(65) Prior Publication Data

US 2016/0016743 A1 Jan. 21, 2016

(30) Foreign Application Priority Data

Jul. 17, 2014 (JP) ..... 2014-146838

(51) Int. Cl.
*B65H 43/00* (2006.01)
*B65H 5/06* (2006.01)
(Continued)

(52) U.S. Cl.
CPC ..... *B65H 5/062* (2013.01); *B65H 5/068* (2013.01); *B65H 29/125* (2013.01); *B65H 29/70* (2013.01);
(Continued)

(58) Field of Classification Search
CPC ..... B65H 5/062; B65H 2404/6111; B65H 2601/2532; B65H 2404/7431;
(Continued)

(56) References Cited

U.S. PATENT DOCUMENTS 8,800,990 B2 * 8/2014 Hatayama ..... B65H 5/062 271/272
9,382,089 B2 * 7/2016 Tanaka ..... B65H 5/062
(Continued)

FOREIGN PATENT DOCUMENTS

JP 02095668 A 4/1990
JP 06064264 A 3/1994
(Continued)

OTHER PUBLICATIONS

Japanese Notification of Rejection Reason(s) corresponding to Application No. 2014-146838; Dispatch Date: Apr. 5, 2016, with English translation.
(Continued)

*Primary Examiner* — Jeremy R Severson
(74) *Attorney, Agent, or Firm* — Cantor Colburn LLP

(57) ABSTRACT

A sheet-conveying device contains a first linear sheet-conveying path on which the sheet is conveyed, a curved sheet-conveying path connecting the first linear sheet-conveying path and a second linear sheet-conveying path connecting the curved sheet-conveying path. A curved conveying guide is provided at only an outside of a curved sheet-conveying route. Conveying guide rollers are provided at an upstream side of the curved conveying guide. The conveying guide rollers contain a driving roller which is arranged at outside of the curved sheet-conveying path and a driven roller which is arranged at inside of the curved sheet-conveying path. The driven roller has a diameter more than that of the driving roller. The driven roller also has hardness less than that of the driving roller.

12 Claims, 12 Drawing Sheets

(51) Int. Cl.
*B65H 29/12* (2006.01)
*B65H 29/70* (2006.01)

(52) U.S. Cl.
CPC ... *B65H 43/00* (2013.01); *B65H 2301/33214* (2013.01); *B65H 2301/33222* (2013.01); *B65H 2301/33312* (2013.01); *B65H 2404/13* (2013.01); *B65H 2404/141* (2013.01); *B65H 2404/1415* (2013.01); *B65H 2404/532* (2013.01); *B65H 2404/5322* (2013.01); *B65H 2404/611* (2013.01); *B65H 2404/612* (2013.01); *B65H 2404/6111* (2013.01); *B65H 2404/7431* (2013.01); *B65H 2513/10* (2013.01); *B65H 2513/108* (2013.01); *B65H 2515/112* (2013.01); *B65H 2601/2532* (2013.01); *B65H 2701/1313* (2013.01); *B65H 2801/06* (2013.01)

(58) Field of Classification Search
CPC .... B65H 2404/612; B65H 2301/33214; B65H 2301/33224; B65H 2404/532; B65H 2404/5322
See application file for complete search history.

(56) References Cited

U.S. PATENT DOCUMENTS

2003/0011126 A1* 1/2003 Miyazawa ..... B65H 5/062 271/264
2005/0001374 A1* 1/2005 Mukai ..... B65H 5/062 271/272
2009/0324311 A1* 12/2009 Matsumoto ..... B65H 5/36 399/400
2010/0320674 A1* 12/2010 Sato ..... B65H 5/062 271/10.12
2011/0241280 A1* 10/2011 Hong ..... B65H 3/5238 271/110
2014/0079460 A1* 3/2014 Kanaya ..... B65H 7/125 400/583
2015/0030366 A1* 1/2015 Honda ..... G03G 15/6576 399/406
2016/0023857 A1* 1/2016 Nakata ..... B65H 5/062 271/227

FOREIGN PATENT DOCUMENTS

JP 2002179318 A 6/2002
JP 2005077732 A 3/2005
JP 2010042910 A 2/2010
JP 2010208021 A 9/2010
JP 2011191706 A 9/2011
JP 2013183175 A 9/2013

OTHER PUBLICATIONS

Japanese Notification of Rejection Reason(s) corresponding to Application No. 2014-146838; Dispatch Date: Nov. 8, 2016, with English translation.
SIPO First Office Action for corresponding CN Patent Application No. 201510420344.2; dated Sep. 29, 2016.
SIPO Notification of Second Office Action for corresponding Chinese Application No. 201510420344.2; dated Jun. 12, 2017.

* cited by examiner

"RELATED ART"

"RELATED ART"

SHEET-CONVEYING DEVICE THAT CONVEYS SHEETS, IMAGE-FORMING APPARATUS USING THE SHEET-CONVEYING DEVICE AND IMAGE-FORMING SYSTEM THAT USES THE SHEET-CONVEYING DEVICE

CROSS REFERENCES TO RELATED APPLICATIONS

The present invention claims priority under 35 U.S.C. § 119 to Japanese Application No. 2014-146838 filed Jul. 17, 2014, the entire content of which is incorporated herein by reference.

BACKGROUND OF THE INVENTION

Field of the Invention

The present invention relates to a sheet-conveying device that conveys sheets, an image-forming apparatus using the sheet-conveying device and an image-forming system that uses such a sheet-conveying device.

Description of Related Art

Device including a sheet-conveying mechanism in an image-forming apparatus, a sheet-stapling apparatus that stapling the sheets and the like contains any guide members constituting a sheet-conveying path. In an image-forming system composed of the image-forming apparatus and various kinds of sheet-processing apparatuses, the sheets on which the image is formed by the image-forming apparatus pass through a sheet-conveying path having any guide members up to their ejections.

When a surface of sheet on which the image is formed contacts any of the guide members, the sheet may be scratched, which is called as "image scratch". Japanese Patent Application Publication No. 2011-191706 discloses a curved sheet-conveying path in which the guide members are curved. In this curved sheet-conveying path, the sheet often contacts any of the curved guide members so that such an image scratch may be easy to occur.

Although the image scratch mainly occurs by contacting an image-formed surface of the sheet with a guide surface of any of the guide members, the image-formed surface of the sheet is particularly easy to contact an inner guide member of the guide members. Accordingly, the image scratch is easy to occur on the curved sheet-conveying path, which causes print quality of an output printed sheet to be remarkably deteriorated.

A past curved sheet-conveying path has coped with the occurrence of this image scratch by a configuration such that a driven roller composed of low friction material such as resin is provided to the inner guide member. Further, such a technology that a plurality of driven rollers constitutes a guide in the curved sheet-conveying path has been proposed (for example, see Japanese Patent Application Publication No. 2005-077732).

SUMMARY OF THE INVENTION

However, when a guide member is provided at an inner side of a sheet-conveying route in the curved sheet-conveying path, even if the above-mentioned driven roller(s) is (are) arranged, it may be impossible to cope with any variation in conveying behavior of the sheet based on species of sheet, paper weight, stiffness, image patterns and the like so that the sheet may contact the inner guide member. This may cause any image scratch to occur. Further, even when a plurality of driven rollers constitutes the guide in the curved sheet-conveying path, the surface of the sheet may contact the plurality of driven rollers so that this may also cause any image scratch to occur.

The present invention addresses the above-described issues by modifying the sheet-conveying device. The present invention has an object to provide a sheet-conveying device that is capable of constituting a desired sheet-conveying path which prevents a sheet from contacting a guide member and prevents the print quality of output printed sheet from being deteriorated, an image-forming apparatus using the sheet-conveying device and an image-forming system that uses such a sheet-conveying device and an image-forming apparatus.

To achieve the above mentioned object, a sheet-conveying device reflecting one aspect of the present invention is a sheet-conveying device containing a curved sheet-conveying path that is formed by a curved conveying guide, the curved sheet-conveying path being arranged at an outside of a sheet-conveying route on which a sheet is conveyed, and a sheet-conveying-direction adjusting member that adjusts a sheet-conveying direction to direct a forward end of the sheet to the curved conveying guide, the sheet-conveying-direction adjusting member being arranged at an upper stream side of the curved conveying guide along the sheet-conveying direction.

According to embodiments of the present invention, it is desired to provide the sheet-conveying device wherein the sheet-conveying-direction adjusting member includes a pair of rollers that nip the sheet, one roller of the pair of rollers, the one roller being arranged at an inside of the curved sheet-conveying route, contains a diameter more than that of the other roller thereof, said other roller being arranged at an outside of the curved sheet-conveying route, and the one roller arranged at the inside of the curved sheet-conveying route contains hardness less than that of the other roller arranged at the outside of the curved sheet-conveying route.

It is also desired to provide the sheet-conveying device wherein the sheet-conveying-direction adjusting member includes a pair of rollers that nip the sheet, one roller of the pair of rollers contains a convex portion on its circumference surface and the other roller thereof contains a concave portion on its circumference surface with the convex portion and the concave portion being faced each other, and the convex portion is inserted into the concave portion at the faced position.

It is further desired to provide the sheet-conveying device further containing conveying rollers configured by a pair of rollers that nip the sheet, the conveying rollers conveying the sheet at the upper stream side of the curved sheet-conveying route.

It is additionally desired to provide the sheet-conveying device further containing a setting portion that sets sheet information on the sheet and a control portion that changes a conveying speed of the sheet to a low speed at a predetermined timing during the sheet is conveyed on the curved sheet-conveying route based on the sheet information set by the setting portion.

It is still further desired to provide the sheet-conveying device wherein when the control portion changes the conveying speed of the sheet to the low speed at the predetermined timing, the control portion performs a control to convey the sheet at the changed low speed during at least a predetermined period in a period of conveying time when a rear end of the sheet is conveyed on the curved sheet-conveying route.

It is still additionally desired to provide the sheet-conveying device wherein the control portion performs a control to return the conveying speed of the sheet to a conveying speed thereof before the change-over to the low speed.

It is also desired to provide the sheet-conveying device wherein the predetermined timing by which the sheet-conveying speed is changed to the low conveying speed is set so as to be a point of time after the rear end of the sheet passes through the sheet-conveying-direction adjusting member.

It is further desired to provide the sheet-conveying device wherein the sheet information includes paper weight or species of the sheet.

Other objects and attainments of the present invention will be become apparent to those skilled in the art upon a reading of the following detailed description when taken in conjunction with the drawing.

DESCRIPTION OF THE PREFERRED EMBODIMENTS

The following will describe embodiments of a sheet-conveying device, an image-forming apparatus and an image-forming system according to the present invention with reference to the drawings.

Figure 1:
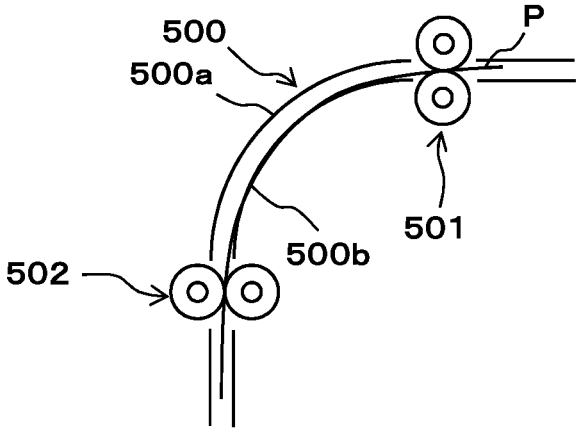
FIG. 1 is a diagram showing a conveying example of a sheet within a curved sheet-conveying path in a past sheet-conveying device.

FIG. 1 shows a conveying example of a sheet within a curved sheet-conveying path in a past sheet-conveying device. According to experimentation and/or sheet-conveying simulation, the sheet is conveyed in the curved sheet-conveying path so that when a forward end of the sheet passes through a roller nip by conveying rollers 501 at an upstream side of the curved sheet-conveying path 500, the sheet P is conveyed along an outer guide member 500*a* with it being supported by the forward end of the sheet and the roller nip.

When conveying rollers 502 provided at a downstream side of the curved sheet-conveying path 500 nip the forward end of the sheet, the conveying rollers 501, 502 provided at the upstream and downstream sides of the curved sheet-conveying path 500 convey the sheet P while a surface of the sheet contacts an inner guide member 500*b*.

The image scratch occurs principally when an image-formed surface of the sheet contacts a guide surface of the guide member. Particularly, the image-formed surface of the sheet is easy to contact the inner guide member so that in the curved sheet-conveying path, the image scratch may often occur. This causes print quality of an output printed sheet to be remarkably deteriorated.

Figure 2:
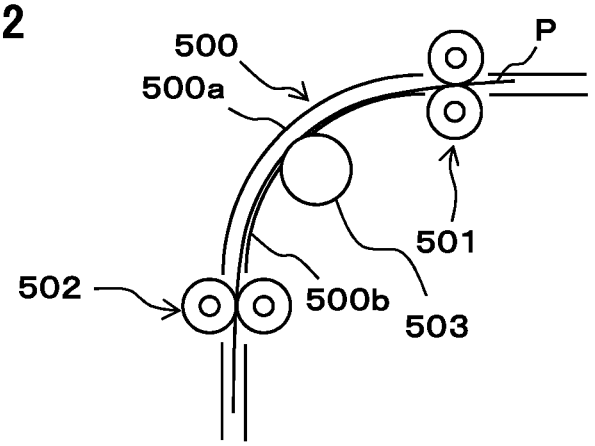
FIG. 2 is a diagram showing a conveying example of a sheet within a curved sheet-conveying path in another past sheet-conveying device corresponding to any image scratch.

FIG. 2 shows a curved sheet-conveying path 500 in another past sheet-conveying device coping with any image scratch. The curved sheet-conveying path 500 in this past sheet-conveying device has coped with any image scratch by arranging a driven roller 503 made of low friction material such as resin on the inner guide member 500*b*.

However, when any guide member is provided at an inner side of a sheet-conveying route of the sheet in the curved sheet-conveying path, even if the above-mentioned driven roller 503 is arranged, it may be impossible to cope with any variation in conveying behavior of the sheet based on species of sheet, paper weight, stiffness, image patterns and the like so that the sheet may contact the inner guide member. This may cause any image scratch to occur.

<Configuration Example of First Embodiment of Sheet-Conveying Device According to Present Invention>

Figure 3:
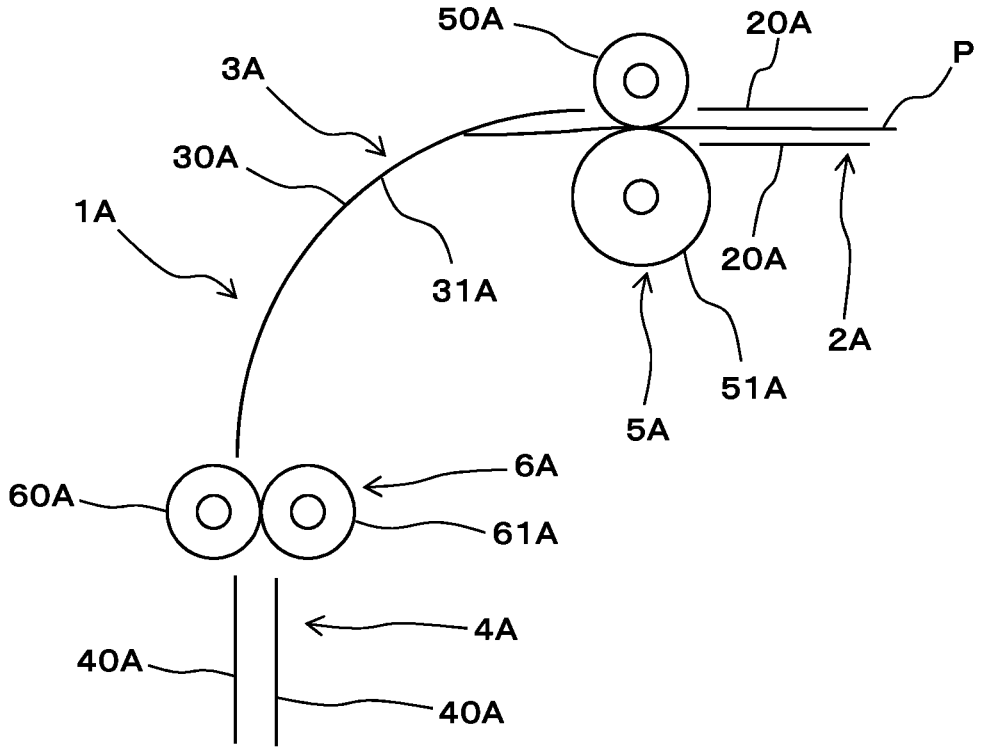
FIG. 3 is a diagram showing a first embodiment of a sheet-conveying device according to the invention.
Figure 4:
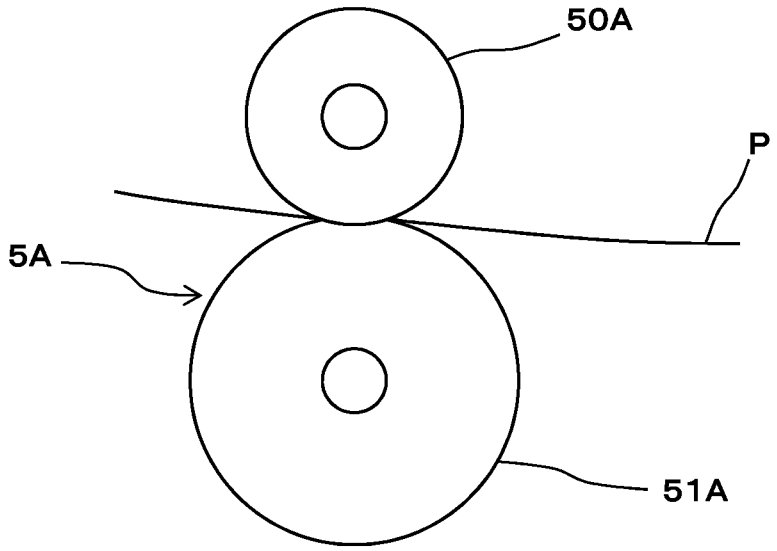
FIG. 4 is a diagram showing an essential part of guide rollers in the first embodiment of a sheet-conveying device according to the invention.

FIG. 3 shows a first embodiment of a sheet-conveying device 1A according to the invention. FIG. 4 shows an essential part of conveying guide rollers 5A in the first embodiment of the sheet-conveying device 1A according to the invention. The first embodiment of sheet-conveying device 1A according to the invention contains a first linear sheet-conveying path 2A on which the sheet P is conveyed, a curved sheet-conveying path 3A connecting the first linear sheet-conveying path 2A and a second linear sheet-conveying path 4A connecting the curved sheet-conveying path 3A.

Further, the sheet-conveying device 1A contains first linear conveying guides 20A constituting the first linear sheet-conveying path 2A, a curved conveying guide 30A constituting the curved sheet-conveying path 3A and second linear conveying guides 40A constituting the second linear sheet-conveying path 4A.

Additionally, the sheet-conveying device 1A contains conveying guide rollers 5A that convey the sheet P at an upstream side of the curved conveying guide 30A and conveying rollers 6A that convey the sheet P at a downstream side of the curved conveying guide 30A.

In the sheet-conveying device 1A according to this embodiment, the first linear sheet-conveying path 2A on which the sheet is horizontally conveyed, the second linear sheet-conveying path 4A on which the sheet P is vertically conveyed down, and the curved sheet-conveying path 3A between the first linear sheet-conveying path 2A and the second linear sheet-conveying path 4A constitute a sheet-conveying route of the sheet P.

A pair of first linear conveying guides 20A, 20A is provided in the first linear sheet-conveying path 2A while they face each other across the sheet-conveying route of the sheet P. A pair of second linear conveying guides 40A, 40A is provided in the second linear sheet-conveying path 4A while they face each other across the sheet-conveying route of the sheet P.

In the curved sheet-conveying path 3A, the curved conveying guide 30A is provided at only an outside of the curved sheet-conveying route of the sheet P. The curved conveying guide 30A guides the sheet P by a curved portion of the curved sheet-conveying path 3A on which the sheet P is conveyed with the forward end of the sheet P contacting a concavely curved guide surface 31A.

The conveying guide rollers 5A (sheet-conveying-direction adjusting member) is provided at a connection point between the first linear sheet-conveying path 2A and the curved sheet-conveying path 3A so that they are arranged at the upstream side of the curved conveying guide 30A along the conveying direction of the sheet P. The conveying guide rollers 5A adjust the conveying direction of the sheet P to direct a forward end of the sheet P passing through the conveying guide rollers 5A to the guide surface 31A of the curved conveying guide 30A.

The conveying guide rollers 5A contain a pair of rollers that nip the sheet P. One roller of the pair of rollers, which is arranged at an inside of the curved sheet-conveying route, has a diameter more than that of the other roller thereof, which is arranged at an outside of the curved sheet-conveying route. The one roller arranged at the inside of the curved sheet-conveying route has hardness less than that of the other roller arranged at the outside of the curved sheet-conveying route.

In this embodiment, the conveying guide rollers 5A contain a driving roller 50A which a motor, not shown, drives and a driven roller 51A opposing the driving roller 50A. The conveying guide rollers 5A constitute conveying rollers of the upstream side, which convey the sheet P at the upstream side of the curved conveying guide 30A.

In the conveying guide rollers 5A, the driving roller 50A is arranged at an outside of the curved sheet-conveying path 3A and the driven roller 51A is arranged at an inside of the curved sheet-conveying path 3A. In the conveying guide rollers 5A, the driven roller 51A has a diameter more than that of the driving roller 50A. The driven roller 51A also has hardness less than that of the driving roller 50A.

Accordingly, at a point on which the driving roller 50A and the driven roller 51A are faced, a circumference of the driven roller 51A changes to be concave conforming to a shape of the circumference of the driving roller 50A.

The sheet P conveyed with it being nipped by the driving roller 50A and the driven roller 51A curves around the circumference of the driving roller 50A, so that the conveying direction of the sheet P can be adjusted to direct the forward end of the sheet P to the curved conveying guide 30A, in a case shown in FIG. 3, to direct the forward end of the sheet P upward.

A configuration of the first linear sheet-conveying path 2A to convey the sheet P to a horizontal direction at the upstream side of the curved sheet-conveying path 3A prevents the forward end of the sheet P from hanging down. Thus, the forward end of the sheet P passing through the conveying guide rollers 5A is directed to the guide surface 31A of the curved conveying guide 30A and then, the sheet P is conveyed along the guide surface 31A of the curved conveying guide 30A within the sheet-conveying route.

Further, the conveying guide rollers 5A may be configured so that the driven roller 51A is arranged at the outside of the curved sheet-conveying route in the curved sheet-conveying path 3A, and the driving roller 50A is arranged at the inside of the curved sheet-conveying route in the curved sheet-conveying path 3A. The driving roller 50A also may have a diameter more than that of the driven roller 51A. The driving roller 50A further may have hardness less than that of the driven roller 51A.

The conveying rollers 6A is provided at a connection point between the curved sheet-conveying path 3A and the second linear sheet-conveying path 4A so that they are arranged at the downstream side of the curved conveying guide 30A along the conveying direction of the sheet P. The conveying rollers 6A contains a driving roller 60A which a motor, not shown, drives and a driven roller 61A opposing the driving roller 60A. The conveying rollers 6A constitute conveying rollers of the downstream side, which convey the sheet P at the downstream side of the curved conveying guide 30A.

A distance between the conveying guide rollers 5A and the conveying rollers 6A is configured so as to be shorter than a minimum length of the conveyable sheet P. This allows the conveying rollers 6A to nip the forward end of the sheet P before a rear end of the sheet P passes through the conveying guide rollers 5A.

<Operation Example of First Embodiment of Sheet-Conveying Device According to the Invention>

Figure 5A:
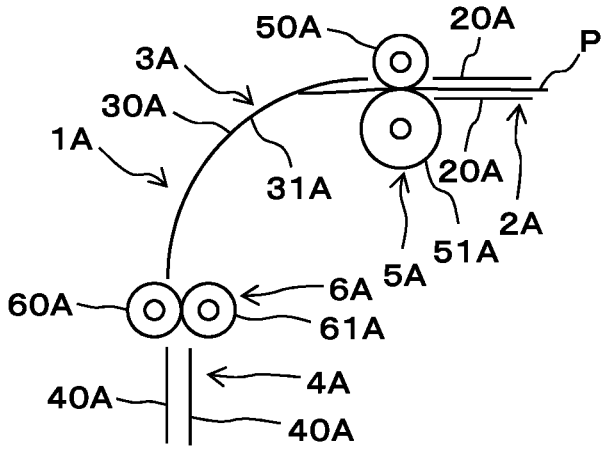
FIG. 5A is a diagram schematically showing the sheet-conveying path in the first embodiment of a sheet-conveying device according to the invention.
Figure 5B:
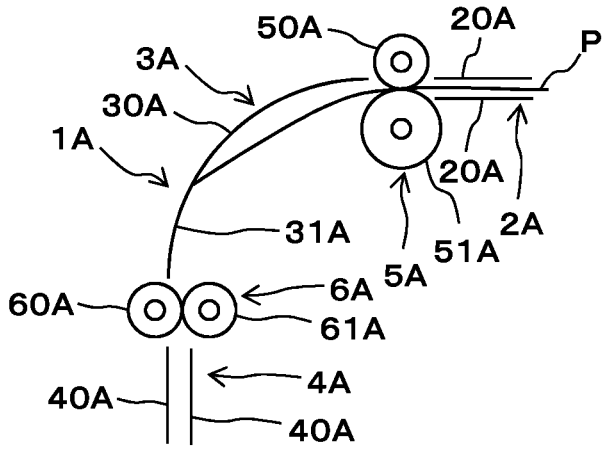
FIG. 5B is a diagram schematically showing the sheet-conveying path in the first embodiment of a sheet-conveying device according to the invention.
Figure 5C:
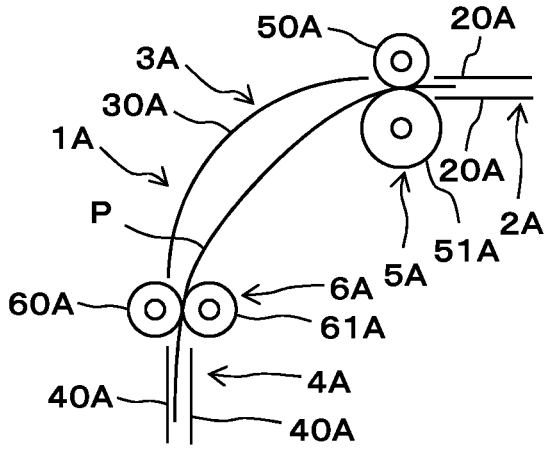
FIG. 5C is a diagram schematically showing the sheet-conveying path in the first embodiment of a sheet-conveying device according to the invention.

FIGS. 5A through 5C schematically show the sheet-conveying route in the first embodiment of the sheet-conveying device 1A according to the invention, respectively. The following will describe operations to convey the sheet P in the first embodiment of the sheet-conveying device 1A with reference to the drawings.

The sheet P nipped by the driving roller 50A and the driven roller 51A curves around the circumference of the driving roller 50A based on a relationship of the diameters of the driving roller 50A and the driven roller 51A and/or a relationship of hardness thereof. This allows the forward end of the sheet P conveyed on the first linear sheet-conveying path 2A and passing through the conveying guide rollers 5A to be directed to the guide surface 31A of the curved conveying guide 30A, as shown in FIG. 5A.

Even when the curved conveying guide 30A is provided at only the outside of the sheet-conveying route of the sheet P in the curved sheet-conveying path 3A, this prevents the forward end of the sheet P passed through the conveying guide rollers 5A from being out of the sheet-conveying route and being curved inwardly.

Accordingly, even when there is no conveying guide at an inside of the sheet-conveying route in the curved sheet-conveying path 3A, as shown in FIG. 5B, the sheet P can be conveyed along the guide surface 31A of the curved conveying guide 30A. Since there is no guide member that can contact the inner surface of the sheet P conveying on the curved sheet-conveying path 3A, it is possible to prevent scratching the inner surface of the sheet P.

The sheet P conveyed on the curved sheet-conveying path 3A is then conveyed to the conveying rollers 6A. The driving roller 60A and the driven roller 61A constituting the conveying rollers 6A nip the forward end of the sheet P.

In a situation where the conveying rollers 6A nip the forward end of the sheet P and the rear end of the sheet P does not passed through the conveying guide rollers 5A which nip the rear end thereof, there may be a case where a part of the sheet P becomes straight between the conveying rollers 6A and the conveying guide rollers 5 without going along the curved conveying guide 30A, as shown in FIG. 5C, based on a relationship between a conveying speed of the conveying rollers 6A and a conveying speed of the conveying guide rollers 5A.

Even in such a situation, since there is no conveying guide at an inside of the sheet-conveying route of the sheet P in the curved sheet-conveying path 3A, the surface of the sheet P does not contact any guide member so that it is possible to prevent scratching the surface of the sheet P.

When the rear end of the sheet P passes through the conveying guide rollers 5A, the conveying rollers 6A convey the sheet P to any latter processing portions from the sheet-conveying device 1A.

<Configuration Example of Second Embodiment of Sheet-Conveying Device According to Present Invention>

Figure 6:
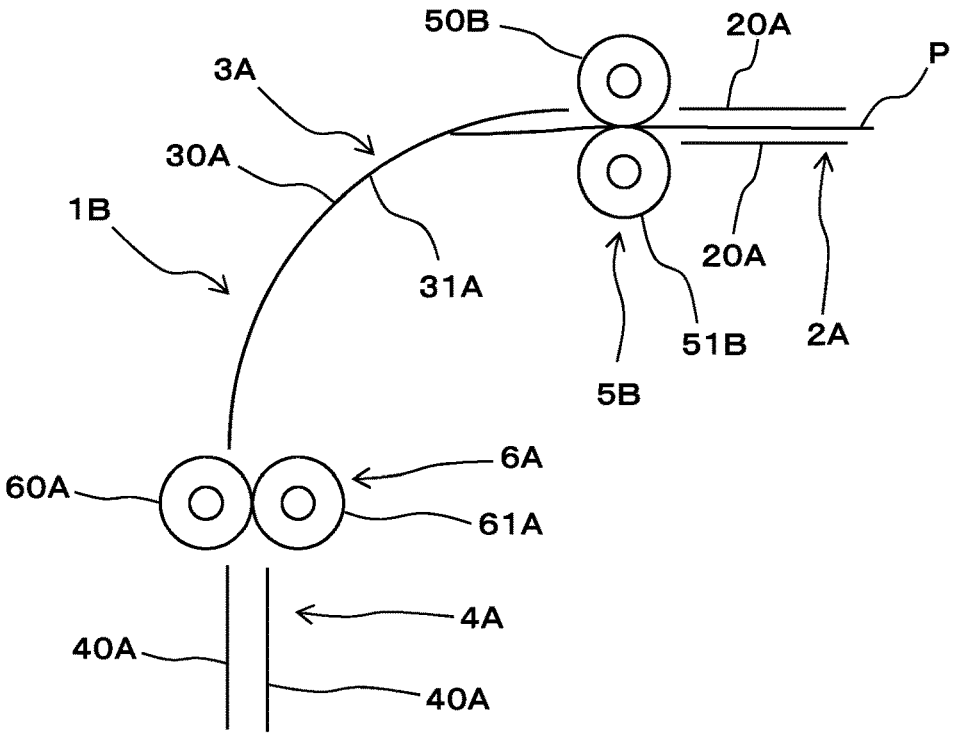
FIG. 6 is a diagram showing a second embodiment of a sheet-conveying device according to the invention.
Figure 7:
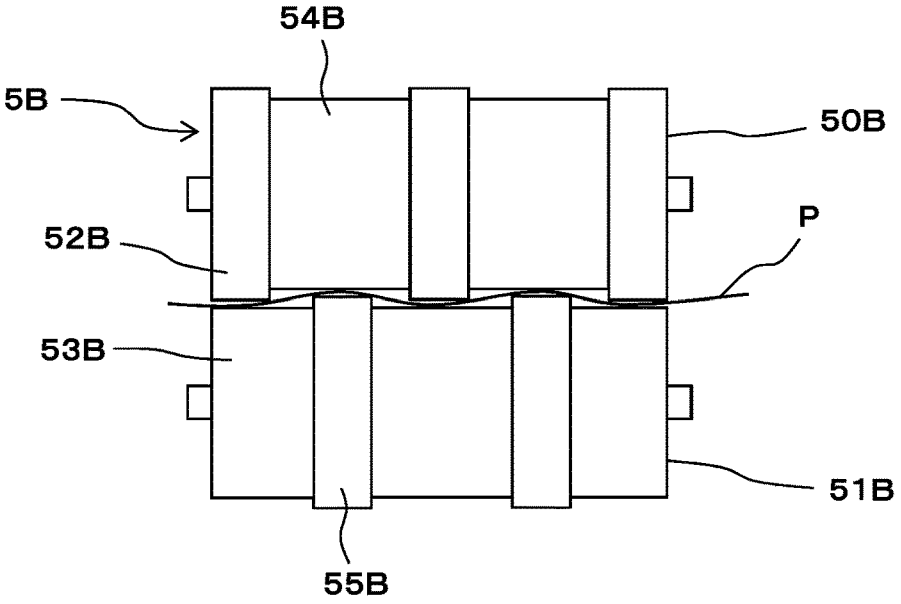
FIG. 7 is a diagram showing an essential part of guide rollers in the second embodiment of a sheet-conveying device according to the invention.

FIG. 6 shows a second embodiment of a sheet-conveying device 1B according to the invention. FIG. 7 shows an essential part of conveying guide rollers in the second embodiment of the sheet-conveying device 1B according to the invention. Like reference numbers applied to like elements of the first embodiment of sheet-conveying device 1A are also applied those of the second embodiment of sheet-conveying device 1B according to the invention. The sheet-conveying device 1B will be described.

Similar to the first embodiment, the second embodiment of sheet-conveying device 1B according to the invention contains a first linear sheet-conveying path 2A on which the first linear conveying guides 20A are provided, a curved sheet-conveying path 3A on which a curved conveying guide 30A is provided at only an outside of the sheet-conveying route of the sheet P and a second linear sheet-conveying path 4A on which the second linear conveying guides 40A are provided.

In the sheet-conveying device 1B, conveying guide rollers 5B corrugate the sheet P to enhance a straight moving of the sheet P passing through the conveying guide rollers 5B. This allows the forward end of the sheet P to be directed to the guide surface 31A of the curved conveying guide 30A. The sheet P is then conveyed in the sheet-conveying route along the guide surface 31A of the curved conveying guide 30A.

The conveying guide rollers 5B (sheet-conveying-direction adjusting member) is provided at a connection point between the first linear sheet-conveying path 2A and the curved sheet-conveying path 3A so that they are arranged at the upstream side of the curved conveying guide 30A along the conveying direction of the sheet P. The conveying guide rollers 5B adjust the conveying direction of the sheet P to direct the sheet P passing through the conveying guide rollers 5B to the guide surface 31A of the curved conveying guide 30A.

The conveying guide rollers 5B contain a pair of rollers that nip the sheet P. One roller of the pair of rollers contains a convex portion on its circumference surface and the other roller thereof contains a concave portion on its circumference surface. In this embodiment, the conveying guide rollers 5B contain a driving roller 50B which a motor, not shown, drives and a driven roller 51B opposing the driving roller 50B. The conveying guide rollers 5B constitute conveying rollers of the upstream side, which convey the sheet P at the upstream side of the curved conveying guide 30A.

In the conveying guide rollers 5B, the convex portion 52B formed on the circumference of the driving roller 50B and the concave portion 53B formed on the circumference of the driven roller 51B face each other. The concave portion 54B formed on the circumference of the driving roller 50B and the convex portion 55B formed on the circumference of the driven roller 51B also face each other. The respective convex portions are inserted into the respective concave portions at the faced positions of the driving roller 50B and the driven roller 51B.

Accordingly, the sheet P conveyed with it being nipped by the driving roller 50B and the driven roller 51B is corrugated along its width direction. Since the sheet P passing through the conveying guide roller 5B maintains its straight shape along the conveying direction of the sheet P, the forward end of the sheet P is directed to the guide surface 31A of the curved conveying guide 30A. The sheet P is then conveyed along the guide surface 31A of the curved conveying guide 30A.

Further, in the conveying guide roller 5B, the driven roller 51B may be arranged at an outside of the curved sheet-conveying path 3A and the driving roller 50B may be arranged at an inside of the curved sheet-conveying path 3A.

<Operation Example of Second Embodiment of Sheet-Conveying Device According to the Invention>

Figure 8A:
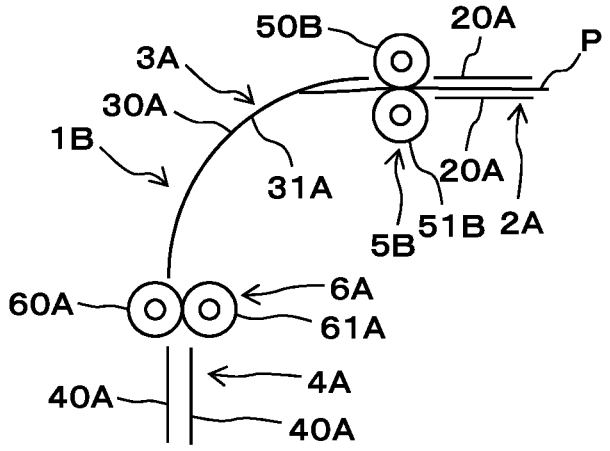
FIG. 8A is a diagram schematically showing the sheet-conveying path in the second embodiment of a sheet-conveying device according to the invention.
Figure 8B:
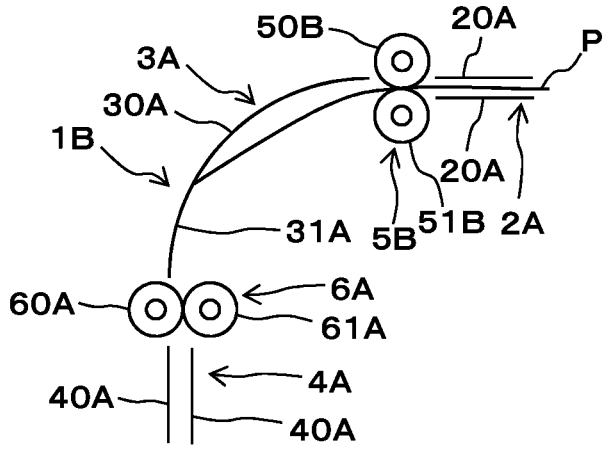
FIG. 8B is a diagram schematically showing the sheet-conveying path in the second embodiment of a sheet-conveying device according to the invention.
Figure 8C:
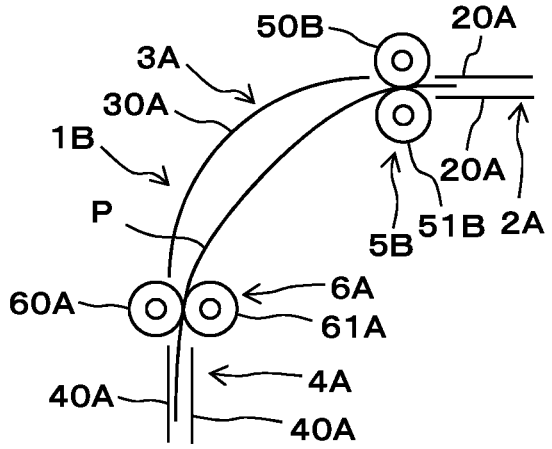
FIG. 8C is a diagram schematically showing the sheet-conveying path in the second embodiment of a sheet-conveying device according to the invention.

FIGS. 8A through 8C schematically show the sheet-conveying route of the sheet in the second embodiment of a sheet-conveying device 1B according to the invention, respectively. The following will describe operations to convey the sheet P in the second embodiment of the sheet-conveying device 1B with reference to the drawings.

The sheet P nipped by the driving roller 50B and the driven roller 51B is corrugated along its width direction by convex and concave portions formed on the circumferences of the driving roller 50B and the driven roller 51B. Since the sheet P conveyed on the first linear sheet-conveying path 2A and passing through the conveying guide rollers 5B maintains its straight shape along the conveying direction of the sheet P, the forward end of the sheet P is directed to the guide surface 31A of the curved conveying guide 30A, as shown in FIG. 8A.

Even when the curved conveying guide 30A is provided at only an outside of the sheet-conveying route of the sheet P in the curved sheet-conveying path 3A, this prevents the forward end of the sheet P passed through the conveying guide rollers 5B from being out of the sheet-conveying route and being curved inwardly.

Accordingly, even when there is no conveying guide at an inside of the sheet-conveying route in the curved sheet-conveying path 3A, as shown in FIG. 8B, the sheet P can be conveyed along the guide surface 31A of the curved conveying guide 30A. Since there is no guide member that can contact the inner surface of the sheet P conveying on the curved sheet-conveying path 3A, it is possible to prevent scratching the surface of the sheet P.

The sheet P conveyed on the curved sheet-conveying path 3A is then conveyed to the conveying rollers 6A. The driving roller 60A and the driven roller 61A constituting the conveying rollers 6A nip the forward end of the sheet P.

In a situation where the conveying rollers 6A nip the forward end of the sheet P and the rear end of the sheet P does not passed through the conveying guide rollers 5B which nip the rear end thereof, there may be a case where a part of the sheet P becomes straight without along the curved conveying guide 30A, as shown in FIG. 8C. Even in such a situation, since there is no conveying guide at an inside of the sheet-conveying route of the sheet P in the curved sheet-conveying path 3A, the surface of the sheet P does not contact any guide member so that it is possible to prevent scratching the surface of the sheet P.

When the rear end of the sheet P passes through the conveying guide rollers 5B, the conveying rollers 6A convey the sheet P to any latter processing portions from the sheet-conveying device 1B.

<Configuration Example of Third Embodiment of Sheet-Conveying Device According to Present Invention>

Figure 9:
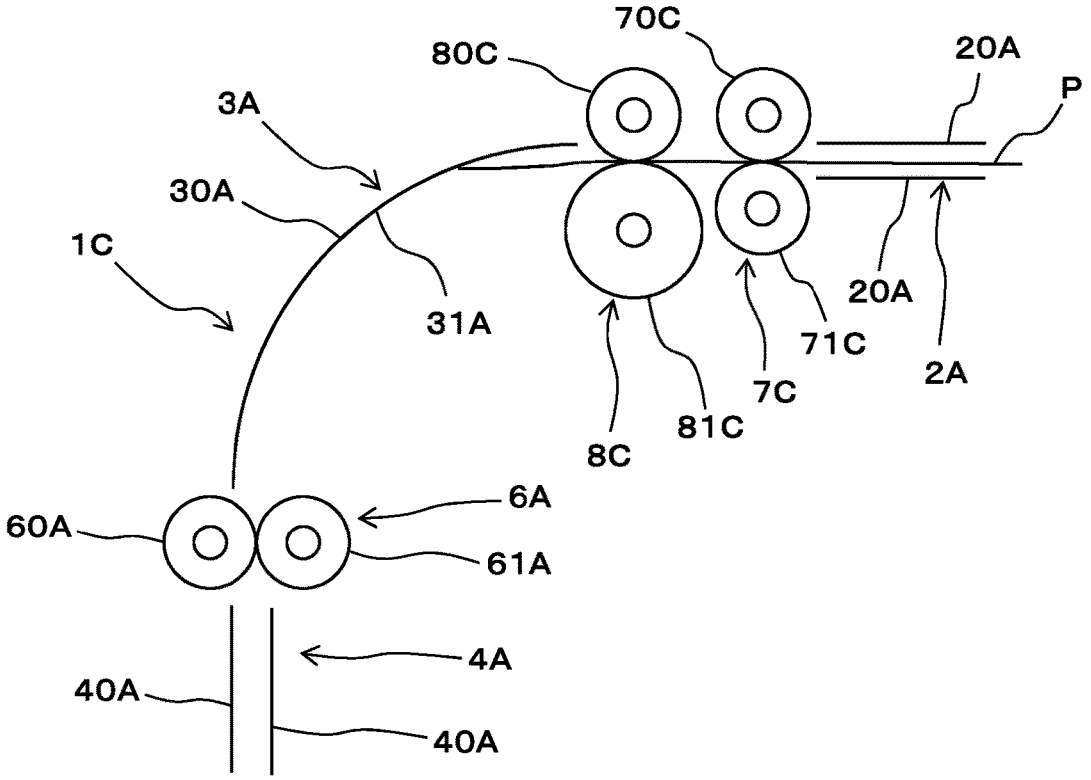
FIG. 9 is a diagram showing a third embodiment of a sheet-conveying device according to the invention.

FIG. 9 shows a third embodiment of a sheet-conveying device 1C according to the invention. Like reference numbers applied to like elements of the first or second embodiment of the sheet-conveying device 1A, 1B are also allied to those of the third embodiment of sheet-conveying device 1C according to the invention. The sheet-conveying device 1C will be described.

Similar to the first embodiment, the third embodiment of sheet-conveying device 1C according to the invention contains a first linear sheet-conveying path 2A on which the first linear conveying guides 20A are provided, a curved sheet-conveying path 3A on which a curved conveying guide 30A is provided at only an outside of the sheet-conveying route of the sheet P and a second linear sheet-conveying path 4A on which the second linear conveying guides 40A are provided.

The sheet-conveying device 1C contains conveying rollers 7C that convey the sheet P and guide rollers 8C that adjust a conveying direction of the sheet P, which is separated from the conveying rollers 7C, at an upstream side of the curved sheet-conveying path 3A.

The conveying guide rollers 8C (sheet-conveying-direction adjusting member) is provided at a connection point between the first linear sheet-conveying path 2A and the curved sheet-conveying path 3A so that they are arranged at the upstream side of the curved conveying guide 30A along the conveying direction of the sheet P. The conveying rollers 7C are provided at the upstream side of the guide rollers 8C.

The conveying rollers 7C contain a driving roller 70C which a motor, not shown, drives and a driven roller 71C opposing the driving roller 70C. The conveying rollers 7C constitute conveying rollers of the upstream side, which convey the sheet P at the upstream side of the curved conveying guide 30A.

The guide rollers 8C has the same configuration as that of the first embodiment of conveying guide rollers 5A except no transfer of driving force and the rotation together with the conveyance of the nipped sheet P. Alternatively, the guide rollers 8C may have the same configuration as that of the second embodiment of conveying guide rollers 5B except no transfer of driving force and the rotation together with the conveyance of the nipped sheet P.

For example, when the guide rollers 8C have the same configuration as that of the conveying guide rollers 5A, in the guide rollers 8C, a first guide roller 80C is provided at an outside of the sheet-conveying route and a second guide roller 81C is provided at an inside of the sheet-conveying route. In the guide rollers 8C, the second guide roller 81C has a diameter more than that of the first guide roller 80C and the second guide roller 81C has hardness less than that of the first guide roller 80C.

Accordingly, at a position where the first and second guide rollers 80C, 81C face each other, the circumference of the second guide roller 81C changes to be concave conforming to a shape of the circumference of the first guide roller 80C.

Therefore, the sheet P nipped by the first guide roller 80C and the second guide roller 81C curves around the circumference of the first guide roller 80C. This allows the forward end of the sheet P passing through the guide rollers 8C to be directed to the guide surface 31A of the curved conveying guide 30A. The sheet P is then conveyed along the guide surface 31A of the curved conveying guide 30A.

Alternatively, when the guide rollers 8C have the same configuration as that of the conveying guide rollers 5B, the convex portion formed on the circumference of the first guide roller 80C and the concave portion formed on the circumference of the second guide roller 81C faced each other. The concave portion formed on the circumference of the first guide roller 80C and the convex portion formed on the circumference of the second guide roller 81C also face each other. The respective convex portions are inserted into the respective concave portions at the faced positions of the first and second guide rollers 80C and 81C.

Accordingly, the sheet P conveyed with it being nipped by the first guide roller 80C and the second guide roller 81C is corrugated along its width direction. Since the sheet P passing through the guide rollers 8C maintains its straight shape along the conveying direction of the sheet P, the forward end of the sheet P is directed to the guide surface 31A of the curved conveying guide 30A. The sheet P is then conveyed along the guide surface 31A of the curved conveying guide 30A.

In the sheet-conveying device 1C, the guide rollers 8C are arranged between the conveying rollers 7C and the conveying rollers 6A. Further, a distance between the conveying rollers 7C and the conveying rollers 6A is configured so as to be shorter than a minimum length of the conveyable sheet P. This allows the conveying rollers 6A to nip the forward end of the sheet P before a rear end of the sheet P passes through the conveying rollers 7C.

<Operation Example of Third Embodiment of Sheet-Conveying Device According to the Invention>

Figure 10A:
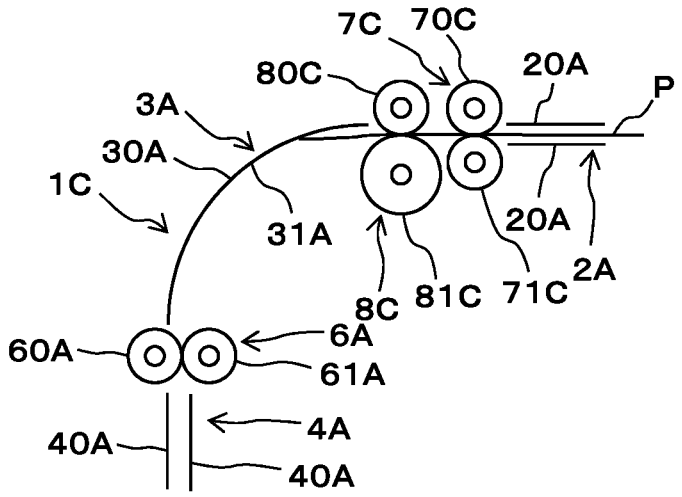
FIG. 10A is a diagram schematically showing the sheet-conveying path in the third embodiment of a sheet-conveying device according to the invention.
Figure 10B:
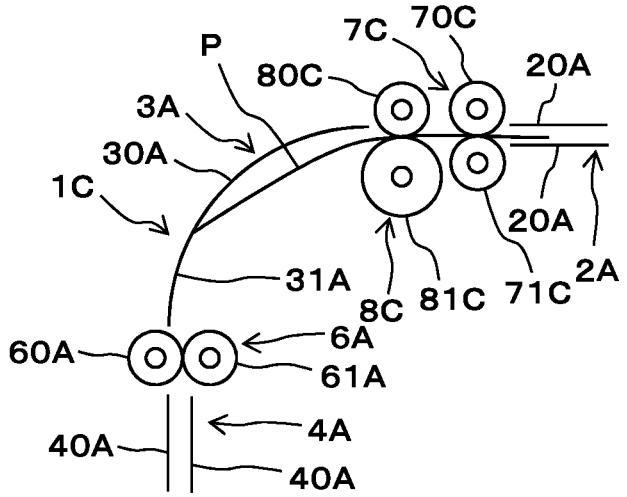
FIG. 10B is a diagram schematically showing the sheet-conveying path in the third embodiment of a sheet-conveying device according to the invention.
Figure 10C:
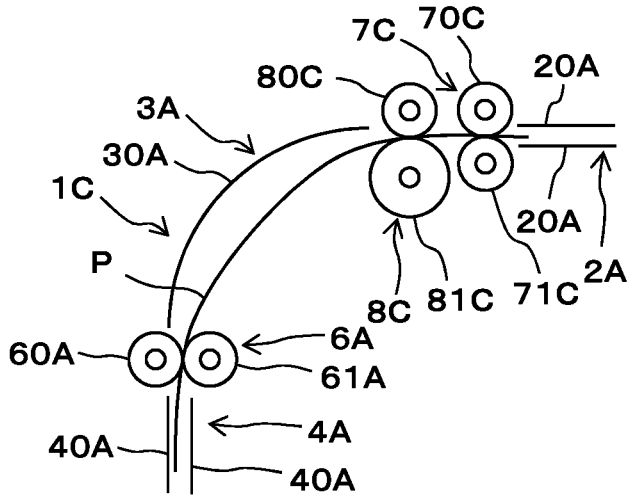
FIG. 10C is a diagram schematically showing the sheet-conveying path in the third embodiment of a sheet-conveying device according to the invention.

FIGS. 10A through 10C schematically show the sheet-conveying route in the third embodiment of a sheet-conveying device according to the invention, respectively. The following will describe operations to convey the sheet P in the third embodiment of the sheet-conveying device 1C with reference to the drawings.

The sheet P which is conveyed by the conveying rollers 7C on the first linear sheet-conveying path 2A and is nipped by the first guide roller 80C and the second guide roller 81C is directed to the guide surface 31A of the curved conveying guide 30A, as shown in FIG. 10A.

Even when the curved conveying guide 30A is provided at only an outside of the sheet-conveying route of the sheet P in the curved sheet-conveying path 3A, this prevents the forward end of the sheet P passed through the guide rollers 8C from being out of the sheet-conveying route and being curved inwardly.

Accordingly, even when there is no conveying guide at an inside of the sheet-conveying route in the curved sheet-conveying path 3A, as shown in FIG. 10B, the sheet P can be conveyed along the guide surface 31A of the curved conveying guide 30A. Since there is no guide member that can contact the inner surface of the sheet P conveying on the curved sheet-conveying path 3A, it is possible to prevent scratching the inner surface of the sheet P.

The sheet P conveyed on the curved sheet-conveying path 3A is then conveyed to the conveying rollers 6A. The driving roller 60A and the driven roller 61A constituting the conveying rollers 6A nip the forward end of the sheet P and further convey the sheet P.

In a situation where the conveying rollers 6A nip the forward end of the sheet P and the rear end of the sheet P does not passed through the conveying rollers 7C which nip the rear end thereof, there may be a case where a part of the sheet P becomes straight without going along the curved conveying guide 30A, as shown in FIG. 10C.

Even in such a situation, since there is no conveying guide at an inside of the sheet-conveying route of the sheet P in the curved sheet-conveying path 3A, the surface of the sheet P does not contact any guide member so that it is possible to prevent scratching the surface of the sheet P.

When the rear end of the sheet P passes through the conveying rollers 7C and the guide rollers 8C, the conveying rollers 6A convey the sheet P to any latter processing portions from the sheet-conveying device 1C.

<Configuration Example of Fourth Embodiment of Sheet-Conveying Device According to Present Invention>

When the rear end of the sheet P passes through the conveying guide rollers 5A and 5B, the conveying rollers 7C and the like in the above-mentioned embodiments of the sheet-conveying device, the rear end of the sheet P may hang downward in such a configuration of the embodiments that the sheet-conveying route is curved downward. When the sheet P is flexibly thin paper, if the rear end of the sheet P hangs downward after the rear end of the sheet P passes through the conveying guide rollers 5A and 5B, the conveying rollers 7C and the like, the rear end of the sheet P springs up toward the curved conveying guide 30A by conveying operation of the conveying rollers 6A, which may cause any cracking noise to occur.

Accordingly, in this embodiment, the conveying speed of the sheet P changes at the conveying guide rollers 5A and 5B, the conveying rollers 7C and the like, which are arranged at the upstream side of the curved sheet-conveying path 3A, and the conveying rollers 6A, which is arranged at the downstream side of the curved sheet-conveying path 3A. This controls a springing-up amount of the rear end of the sheet P.

Figure 11:
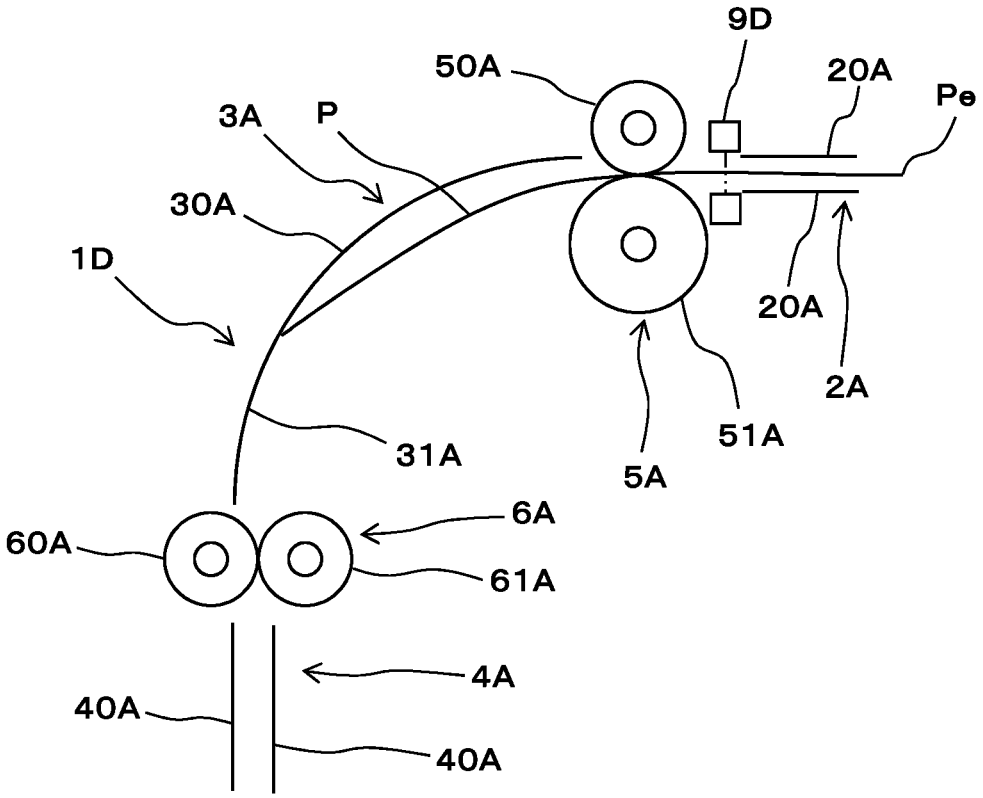
FIG. 11 is a diagram showing a fourth embodiment of a sheet-conveying device according to the invention.

FIG. 11 shows a fourth embodiment of a sheet-conveying device 1D according to the invention. Here, although, as the whole configuration of the sheet-conveying device 1D shown in FIG. 11, a case where the first embodiment of the sheet-conveying device 1A is applied is illustrated, the second or third embodiment of the sheet-conveying device is applicable thereto. A description of a case where the second or third embodiment of the sheet-conveying device is applied thereto will be omitted.

The fourth embodiment of sheet-conveying device 1D according to the invention contains a first linear sheet-conveying path 2A on which the first linear conveying guides 20A are provided, a curved sheet-conveying path 3A on which a curved conveying guide 30A is provided at only an outside of the sheet-conveying route of the sheet P and a second linear sheet-conveying path 4A on which the second linear conveying guides 40A are provided.

The sheet-conveying device 1D contains conveying guide rollers 5A at an upstream side of the curved sheet-conveying path 3A and conveying rollers 6A at a downstream side of the curved sheet-conveying path 3A. The sheet-conveying device 1D also contains a sheet detection sensor 9D at an upstream side of the conveying guide rollers 5A.

Figure 12:
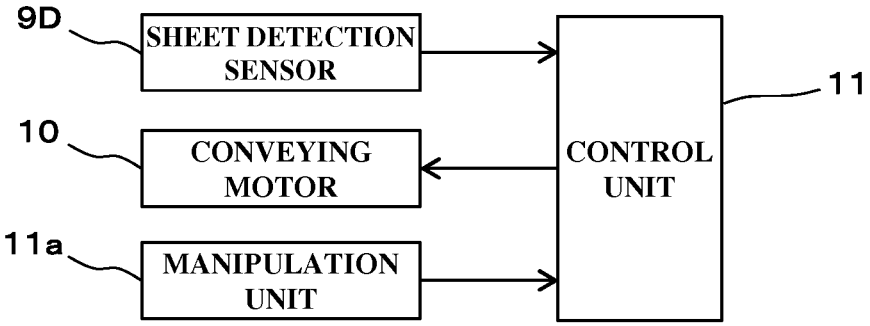
FIG. 12 is a block diagram showing a control example of the fourth embodiment of a sheet-conveying device according to the invention.

FIG. 12 shows a control configuration example of the fourth embodiment of sheet-conveying device 1D according to the invention. A conveying motor 10, the sheet detection sensor 9D, a control unit 11 and a manipulation unit 11*a* implement the control of the sheet-conveying device 1D.

The conveying motor is an example of driving means and drives the driving roller 50A of the conveying guide rollers 5A and a driving roller 60A of the conveying rollers 6A. The sheet detection sensor 9D is an example of sheet detection means and detects a rear end of the sheet P conveyed by the conveying guide rollers 5A and the conveying rollers 6A.

The manipulation unit 11*a* which is a setting portion receives setting of sheet information by a user. The sheet information includes species of sheet (plain paper, color paper, fine paper, matt coated paper, gloss coated paper and the like), paper weight, sheet size and the like.

The control unit 11 contains CPU and a memory. The control unit 11 determines a position of the sheet P based on the detection of the rear end Pe of the sheet P by the sheet detection sensor 9D when CPU implements a program stored in the memory. The control unit 11 then controls the conveying motor 10 to change the conveying speed of the sheet P.

<Operation Example of Fourth Embodiment of Sheet-Conveying Device According to the Invention>

Figure 13A:
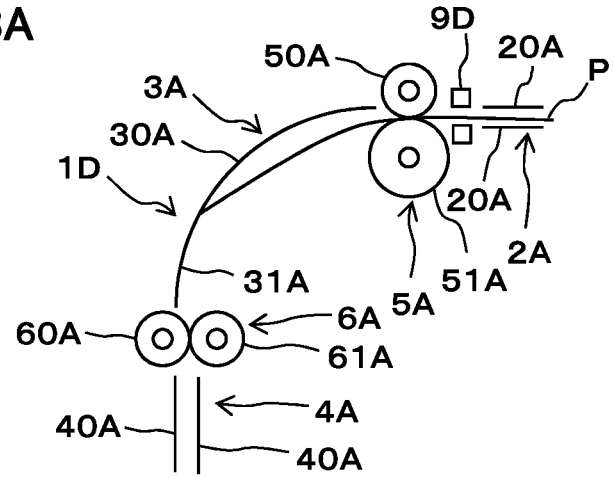
FIG. 13A is a diagram schematically showing the sheet-conveying path in the fourth embodiment of a sheet-conveying device according to the invention.
Figure 13B:
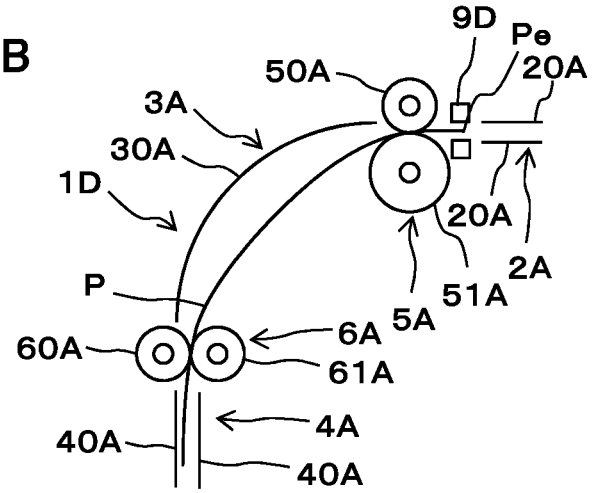
FIG. 13B is a diagram schematically showing the sheet-conveying path in the fourth embodiment of a sheet-conveying device according to the invention.
Figure 13C:
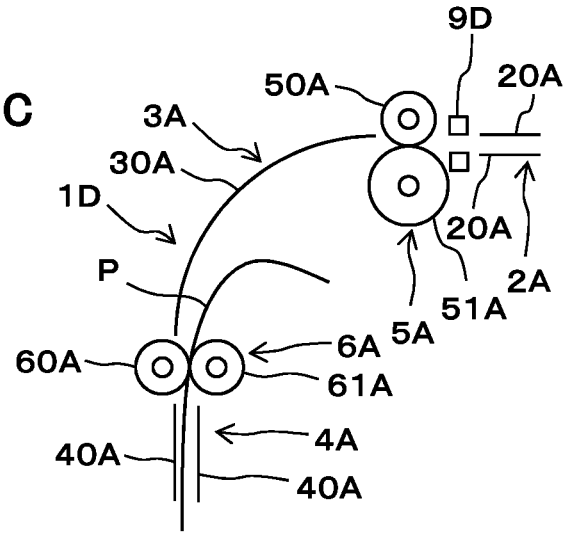
FIG. 13C is a diagram schematically showing the sheet-conveying path in the fourth embodiment of a sheet-conveying device according to the invention.
Figure 14:
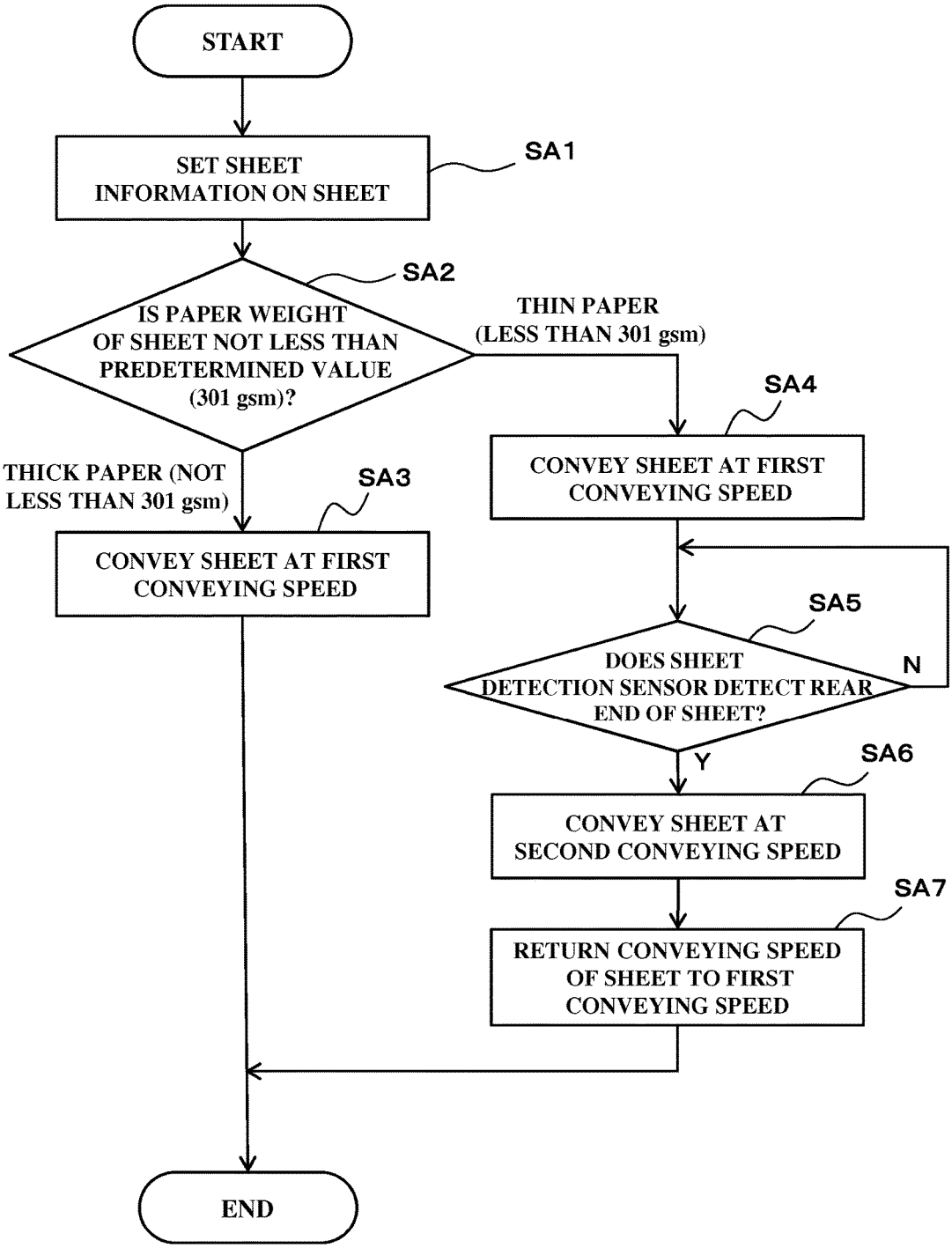
FIG. 14 is a flow chart showing an operation example of the fourth embodiment of a sheet-conveying device according to the invention.

FIGS. 13A through 13C schematically show the sheet-conveying route in the fourth embodiment of a sheet-conveying device 1D according to the invention, respectively. FIG. 14 shows an operation example of the fourth embodiment of the sheet-conveying device 1D according to the invention. The following will describe operations to convey the sheet P in the fourth embodiment of the sheet-conveying device 1D with reference to FIGS. 13A through 13C and 14.

The control unit 11 of the sheet-conveying device 1D realizes processing procedure indicated by the flowchart shown in FIG. 14 when CPU implements a program stored in the memory. Referring to FIG. 14, the control unit 11 receives setting of the sheet information on the sheet P to be conveyed by the manipulation unit 11*a* before conveyance of the sheet P (Step SA1). The control unit 11 acquires, for example in this embodiment, paper weight from the sheet information set in the step SA1 and determines whether or not the paper weight of the sheet P is not less than a predetermined value. In this embodiment, the predetermined value of the paper weight of the sheet P is set to be 301 gsm. If the paper weight of the sheet P is not less than 301 gsm, the control unit 11 determines the sheet P is thick paper which is hardly influenced when the rear end of the sheet P springs up and then, the control unit 11 goes to a step SA3. On the other hand, if the paper weight of the sheet P is less than a predetermined value, in this embodiment, less than 301 gsm, the control unit 11 determines the sheet P is thin paper which is influenced when the rear end of the sheet P springs up and then, the control unit 11 goes to a step SA4.

At the step SA3, the control unit 11 controls the conveying motor 10 to convey the sheet P at a first conveying speed. Specifically, when the control unit 11 determines that the paper weight of the sheet P is not less than the predetermined value at the step SA2, the control unit 11 controls the conveying motor 10 to convey the sheet P at the first conveying speed as it is without any change of conveying speed of the sheet P.

Referring to FIGS. 13A through 13C, when this embodiment of the sheet-conveying device 1D conveys the sheet P at the first conveying speed, the sheet P nipped by the driving roller 50A and the driven roller 51A curves around the circumference of the driving roller 50A. This allows the forward end of the sheet P passing through the conveying guide rollers 5A to be directed to the guide surface 31A of the curved conveying guide 30A.

Even when the curved conveying guide 30A is provided at only an outside of the sheet-conveying route of the sheet P in the curved sheet-conveying path 3A, this prevents the forward end of the sheet P passed through the conveying guide rollers 5A from being out of the sheet-conveying route and being curved inwardly.

Accordingly, even when there is no conveying guide at an inside of the sheet-conveying route in the curved sheet-conveying path 3A, as shown in FIG. 13A, the sheet P can be conveyed along the guide surface 31A of the curved conveying guide 30A. Since there is no guide member that can contact the inner surface of the sheet P conveying on the curved sheet-conveying path 3A, it is possible to prevent scratching the inner surface of the sheet P.

Referring back to FIG. 14, when the control unit 11 determines that the paper weight of the sheet P is less than the predetermined value at the step SA2, the control unit 11 goes to the step SA4 where the control unit 11 controls the conveying motor 10 to convey the sheet P at the first conveying speed up to a predetermined timing. Specifically, the control unit 11 controls the conveying motor 10 to convey the sheet P at the first conveying speed up to timing when the sheet detection sensor 9D detects the rear end of the sheet P, namely, up to timing when the control unit 11 determines that the sheet detection sensor 9D detects the rear end of the sheet P (YES) at a step SA5.

If the sheet detection sensor 9D detects the rear end of the sheet P (in case of YES in the step SA5), the control unit 11 changes the conveying speed of the sheet P from the first conveying speed to a second conveying speed that is slower than the first conveying speed (Step SA6).

When conveying the sheet P by predetermined distance according a size of the sheet P, the control unit 11 returns the conveying speed of the sheet P to the first conveying speed (Step SA7).

Referring to FIGS. 13A through 13C, when this embodiment of the sheet-conveying device 1D conveys the sheet P at the first conveying speed, the sheet P conveyed with it being nipped by the driving roller 50A and the driven roller 51A is conveyed along the guide surface 31A of the curved conveying guide 30A, as shown in FIG. 13A.

The driving roller 60A and the driven roller 61A constituting the conveying rollers 6A nip the forward end of the sheet P conveyed on the curved sheet-conveying path 3A and then, further convey the sheet P. As shown in FIG. 13B, when the sheet detection sensor 9D detects the rear end Pe of the sheet P, the control unit 11 decreases the conveying speed of the sheet P from the first conveying speed to a second conveying speed.

In this embodiment, before the rear end Pe of the sheet P passes through the conveying guide rollers 5A or at a predetermined timing after the rear end Pe of the sheet P passes through the conveying guide rollers 5A, the control unit 11 controls the conveying motor 10 to decreases the conveying speed of the sheet P from the first conveying speed to a second conveying speed.

This controls a springing-up amount of the rear end Pe of the sheet P when the sheet P is conveyed from a situation where the rear end Pe of the sheet P hangs down after the rear end Pe of the sheet P has passed through the conveying guide rollers 5A. Accordingly, this prevents the rear end Pe of the sheet P from colliding against the curved conveying guide 30A and suppresses any cracking noise.

Further, as shown in FIG. 13C, the control unit 11 controls the conveying motor 10 to return the conveying speed of the sheet P to the first conveying speed at a predetermined timing before the rear end Pe of the sheet P passes through the conveying rollers 6A. This prevents processing speed from being made slow.

When decreasing the conveying speed of the sheet P to the second conveying speed at the predetermined timing, the control unit 11 controls the conveying motor 10 to convey the sheet P at the second conveying speed during at least a predetermined period of time, for example, a predetermined timing before the rear end Pe of the sheet P passes through the conveying rollers 6A, in a period of time while the rear end Pe of the sheet P is conveyed on the curved sheet-conveying path 3A. This prevents the rear end Pe of the sheet P from colliding against the curved conveying guide 30A when returning the conveying speed of the sheet P to the first conveying speed and suppresses any cracking noise.

Although the sheet detection sensor 9D has been arranged at the upstream side of the conveying guide rollers 5A in this embodiment, the sheet detection sensor 9D may be arranged between the conveying guide rollers 5A and the conveying rollers 6B or at the downstream side of the conveying rollers 6A. The sheet detection sensor 9D may be arranged at a predetermined position in the sheet-conveying route of the sheet P and detect a forward end of the sheet P so that a conveyed amount of the sheet P can be obtained. The control unit may control a timing on which the conveying speed of the sheet P changes.

Although in this embodiment, the control unit 11 has changed over processing procedure of the step SA3 and processing procedure of the steps SA4 through SA7 in the step SA2 in the flowchart shown in FIG. 14 based on the paper weight of the sheet P, the control unit 11 can change over the processing procedure based on species of sheet (plain paper, color paper, fine paper, matt coated paper, gloss coated paper and the like) to replace the paper weight. Further, the control unit 11 can change over the processing procedure based on species of sheet and the paper weight.

Additionally, although the manipulation unit 11*a* has received the sheet information from the user in this embodiment, any information processing equipment (Personal Computer) connected to the sheet-conveying device 1D through network connection may receive the sheet information.

<Configuration Example of Image-Forming Apparatus According to Present Invention>

Figure 15:
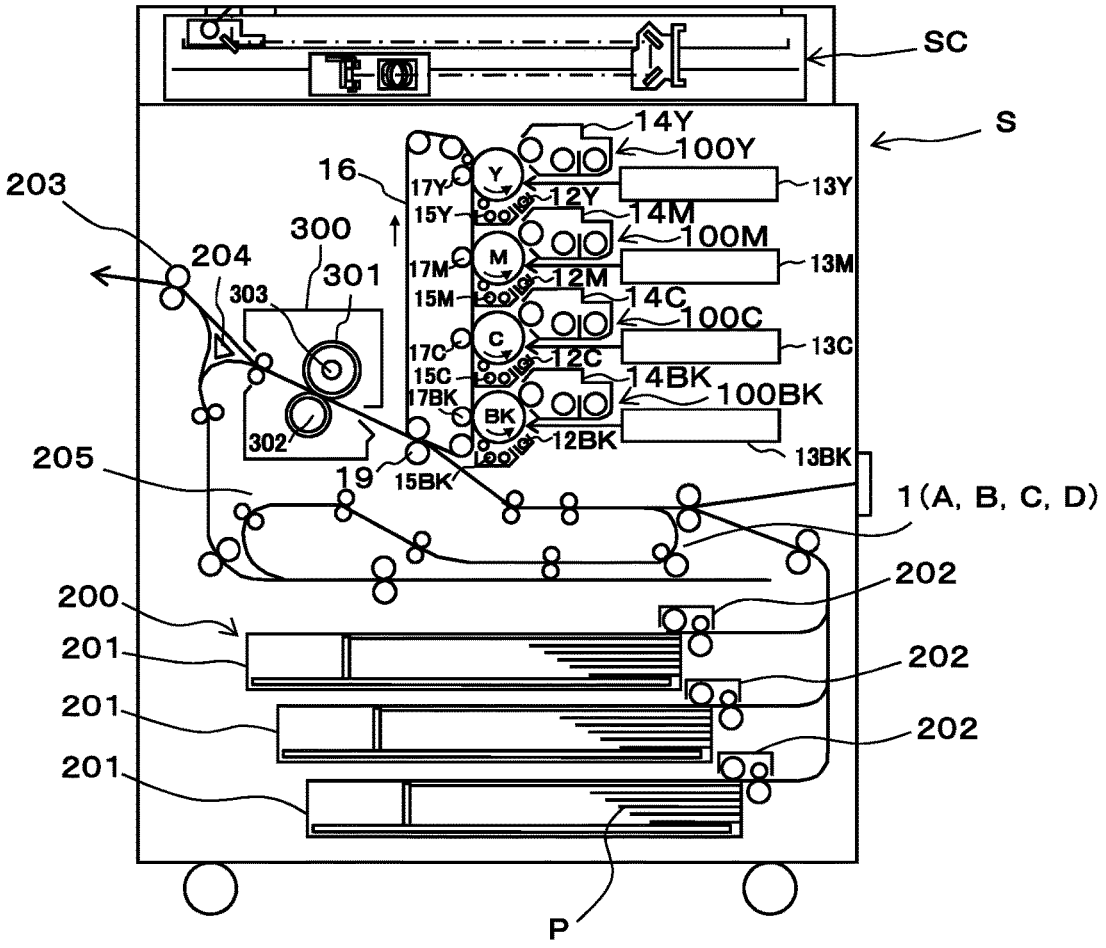
FIG. 15 is a diagram schematically showing an embodiment of an image-forming apparatus according to the invention.

FIG. 15 schematically shows an embodiment of an image-forming apparatus according to the invention. The image-forming apparatus is an electrophotographic image-forming apparatus such as copier and is an image forming apparatus called as "tandem type image-forming apparatus" in which plural photoreceptors are vertically arranged with them facing one intermediate transfer belt to form full-color image.

The image-forming apparatus S mainly contains an image-reading portion SC, image-forming portions 100Y, 100M, 100C and 100BK, a sheet-conveying portion 200, fixing device 300 and the like. They are enclosed in one case.

The image-reading portion SC scans and exposes image on the document using an optical system in a scanning and exposure device and reads reflected light using a line image sensor to obtain an image information signal.

The image-forming portions 100Y forms a yellow (Y) image. The image-forming portion 100M forms a magenta (M) image. The image-forming portion 100C forms a cyan (C) image. The image-forming portion 100BK forms a black (BK) image.

The image-forming portion 100Y includes a photosensitive drum Y, a charging portion 12Y arranged around the photosensitive drum Y, an optical writing (exposure) portion 13Y, a developing portion 14Y and a drum cleaner 15Y. Similarly, the image-forming units 100M, 100C and 100BK respectively include photosensitive drum M, C and BK, charging portions 12M, 12C and 12BK respectively arranged around the photosensitive drums M, C and BK, optical writing (exposure) portions 13M, 13C and 13BK, developing portion 14M, 14C and 14BK, and drum cleaners 15M, 15C and 15BK.

Each of the charging portions 12Y, 12M, 12C and 12BK uniformly charges static charges around a surface of each of the photosensitive drums Y, M, C and BK. Each of the optical writing (exposure) portions 13Y, 13M, 13C and 13BK scans each of the photosensitive drums Y, M, C and BK to form electrostatic latent images on each of the photosensitive drums Y, M, C and BK. Each of the developing portions 14Y, 14M, 14C and 14BK develops the electrostatic latent images using toners. Thus, a toner image that is visible image is formed on each of the photosensitive drums Y, M, C and BK. Accordingly, an image (toner image) of desired color is formed on each of the photosensitive drums Y, M, C and BK corresponding to any one of the yellow, magenta, cyan and black colors. Primary transfer rollers 17Y, 17M, 17C and 17BK transfer the images formed on the photosensitive drums Y, M, C and BK one by one on their predetermined positions of the intermediate transfer belt 16 which is an intermediate transfer body of an endless belt.

Secondary transfer rollers 19 transfer the images of respective colors transferred onto the intermediate transfer belt 16 onto the sheet P conveyed from the sheet-conveying portion 200 at a predetermined timing. The secondary transfer rollers 19 are arranged to contact the intermediate transfer belt 16 so that they from a nip portion (transfer nip portion). The secondary transfer rollers 19 transfer the color image on the sheet P with the sheet P being conveyed.

The sheet-conveying portion 200 conveys the sheets P one by one along the sheet-conveying route. The sheets P are contained in each of the feeding trays 201. The feeder 202 feeds the sheets P contained in the feeding tray 201 one by one to the sheet-conveying route. In the sheet-conveying route, plural conveying members for conveying the sheet P are provided at the upstream side of the transfer nip portion. Each conveying member is composed of a pair of rollers that are contacted with pressure to each other. At least one roller thereof rotates and drives by the conveying motor as driving means. The conveying member rotates with the sheet P being nipped to convey the sheet P. The conveying member is not limited to the pair of rollers: The conveying member may be composed of a pair of rotation members such as a combination of belts and a combination of the belt and the roller.

The fixing device 300 fixes an image transferred on the sheet P. The fixing device 300 contains a pair of fixing members which are arranged to contact each other with pressure and form a nip portion (fixing nip portion) and heating means for heating the fixing device 300. As the pair of fixing members, for example, fixing rollers 301, 302 can be used. As the heating means, a fixing heater 303 can be used. The fixing heater 303 is turned on by energizing it. As the fixing heater 303, halogen lamp can be used. The fixing heater 303 fixes the image on the sheet P by pressure fixing of the pair of fixing rollers 301, 302 and heat fixing of the fixing heater 303 together with conveyance of the sheet P.

Ejection rollers 203 eject the sheet P fixed by the fixing device 300. When forming another image on a rear surface of the sheet P, a conveying path changeover gate 204 changes over a conveying path to a reverse conveying path 205 which is provided at the downstream side of the fixing device 300. The sheet P in which the image has been already formed on the surface thereof is conveyed to the reverse conveying path 205. The reverse conveying path 205 reverses the sheet P and conveys the sheet P to the sheet-conveying route.

In the image-forming apparatus S having the above-mentioned configuration, the embodiment of the sheet-conveying device 1A, 1B, 1C or 1D is used in a curved sheet-conveying path constituting the sheet-conveying portion 200.

By providing the sheet-conveying device 1A, 1B, 1C or 1D in the sheet-conveying route on which the image-formed sheet P is conveyed, even when there is no conveying guide at an inside of the sheet-conveying route of the sheet P in the curved sheet-conveying path 3A, the sheet P is conveyed along the guide surface of the curved conveying guide provided at outside of the sheet-conveying route. Since there is no guide member that can contact the image-formed surface of the sheet P conveying on the curved sheet-conveying route, it is possible to prevent scratching the image-formed surface of the sheet P.

<Configuration Example of Image-Forming System According to Present Invention>

Figure 16:
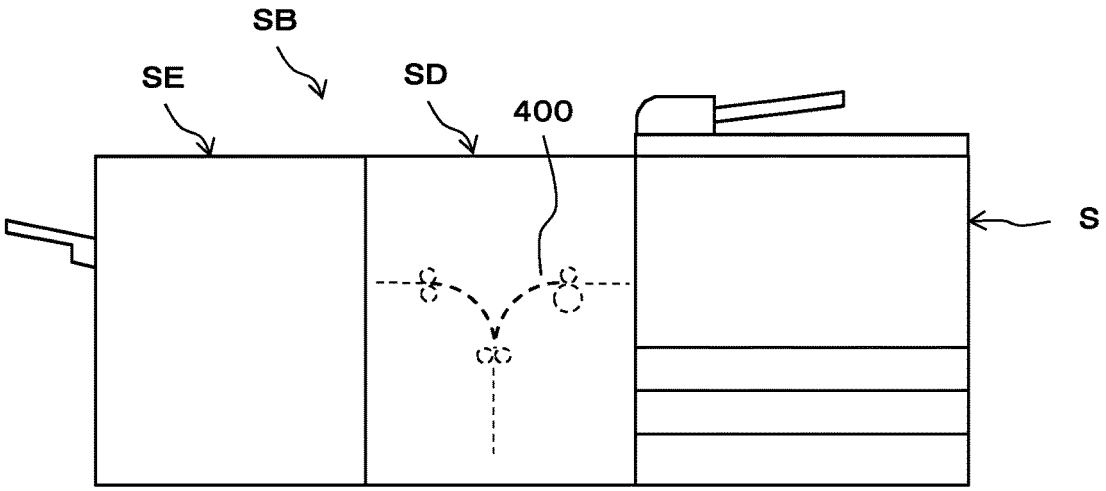
FIG. 16 is a diagram schematically showing an embodiment of an image-forming system according to the invention.

FIG. 16 schematically shows an embodiment of an image-forming system SB according to the invention. The embodiment of image-forming system SB contains the image-forming apparatus S, shown in FIG. 15, which forms the image on the sheet P, a sheet-reversing apparatus SD that reverses the sheet P on which the image has been formed by the image-forming apparatus S, and a sheet-stapling apparatus SE that staples the sheets P.

The sheet-reversing apparatus SD and the sheet-stapling apparatus SE are illustrated as examples of a sheet-processing apparatus. For example, in the sheet-reversing apparatus SD, the embodiment of the sheet-conveying device 1A, 1B, 1C or 1D is provided in a given curved sheet-conveying route 400 constituting the sheet-conveying portion.

By providing the sheet-conveying device 1A, 1B, 1C or 1D in the sheet-conveying route on which the image-formed sheet P is conveyed within the sheet-processing apparatus that performs a predetermined processing on the sheet(s) P on which the image-forming apparatus S forms the image, even when there is no conveying guide at an inside of the sheet-conveying route of the sheet P in the curved sheet-conveying path, the sheet P is conveyed along the guide surface of the curved conveying guide provided at outside of the sheet-conveying route. Since there is no guide member that can contact the image-formed surface of the sheet P conveying on the curved sheet-conveying route, it is possible to prevent scratching the image-formed surface of the sheet P.

Although in the above-mentioned image-forming apparatus S and the image-forming system SB, a case where the sheet-conveying device 1A, 1B, 1C or 1D is provided in the sheet-conveying route on which the image-formed sheet P is conveyed has been described, the sheet-conveying device 1A, 1B, 1C or 1D may be provided in the sheet-conveying route on which the sheet P before the image is formed is conveyed. This prevents the sheet P before the image is formed from scratching, which also prevents an image from being formed on the scratched surface of the sheet P. It is thus possible to improve any printing quality.

This invention is applicable to an apparatus which is provided with a sheet-conveying route of a sheet on which an image is formed in a curved sheet-conveying path.

The terms and expressions which have been employed in the foregoing description are used therein as terms of description and not of limitation, and these are no intention, in the use of such terms and expressions, of excluding equivalent of the features shown and described or portions thereof, it being recognized that the scope of the invention is defined and limited only by the claims.

What is claimed is:

1. A sheet-conveying device comprising:

a curved sheet-conveying path that is formed by a curved conveying guide, the curved sheet-conveying path being arranged at an outside of a sheet-conveying route on which a sheet is conveyed and the curved conveying guide being arranged at only an outside of the sheet-conveying route in the curved sheet-conveying path; and a sheet-conveying-direction adjusting member that adjusts a sheet-conveying direction to direct a forward end of the sheet to the curved conveying guide, the sheet-conveying-direction adjusting member being arranged at an upper stream side of the curved conveying guide along the sheet-conveying direction;

wherein the sheet-conveying-direction adjusting member includes a pair of rollers that nip the sheet;

one roller of the pair of rollers, said one roller being arranged at an inside of the curved sheet-conveying route, contains a diameter more than that of the other roller thereof, said other roller being arranged at an outside of the curved sheet-conveying route; and said one roller arranged at the inside of the curved sheet-conveying route contains hardness less than that of the other roller arranged at the outside of the curved sheet-conveying route.

2. The sheet-conveying device according to claim 1 wherein the sheet-conveying-direction adjusting member includes a pair of rollers that nip the sheet;

one roller of the pair of rollers contains a convex portion on its circumference surface and the other roller thereof contains a concave portion on its circumference surface with the convex portion and the concave portion being faced each other; and the convex portion is inserted into the concave portion at the faced position.

3. The sheet-conveying device according to claim 1 further comprising conveying rollers configured by a pair of rollers that nip the sheet, the conveying rollers conveying the sheet at the upper stream side of the curved sheet-conveying route.

4. The sheet-conveying device according to claim 1 further comprising a setting portion that sets sheet information on the sheet; and a control portion that changes a conveying speed of the sheet to a low speed at a predetermined timing during the sheet is conveyed on the curved sheet-conveying route based on the sheet information set by the setting portion.

5. The sheet-conveying device according to claim 4 wherein when the control portion changes the conveying speed of the sheet to the low speed at the predetermined timing, the control portion performs a control to convey the sheet at the changed low speed during at least a predetermined period in a period of conveying time when a rear end of the sheet is conveyed on the curved sheet-conveying route.

6. The sheet-conveying device according to claim 5 wherein the control portion performs a control to return the conveying speed of the sheet to a conveying speed thereof before the change-over to the low speed.

7. The sheet-conveying device according to claim 4 wherein the predetermined timing by which the sheet-conveying speed is changed to the low conveying speed is set so as to be a point of time after the rear end of the sheet passes through the sheet-conveying-direction adjusting member.

8. The sheet-conveying device according to claim 4 wherein the sheet information includes paper weight or species of the sheet.

9. An image-forming apparatus comprising a sheet-conveying device including:

a curved sheet-conveying path that is formed by a curved conveying guide, the curved sheet-conveying path being arranged at an outside of a sheet-conveying route on which a sheet is conveyed and the curved conveying guide being arranged at only an outside of the sheet-conveying route in the curved sheet-conveying path; and a sheet-conveying-direction adjusting member that adjusts a sheet-conveying direction to direct a forward end of the sheet to the curved conveying guide, the sheet-conveying-direction adjusting member being arranged at an upper stream side of the curved conveying guide along the sheet-conveying direction;

wherein the sheet-conveying-direction adjusting member includes a pair of rollers that nip the sheet;

one roller of the pair of rollers, said one roller being arranged at an inside of the curved sheet-conveying route, contains a diameter more than that of the other roller thereof, said other roller being arranged at an outside of the curved sheet-conveying route; and said one roller arranged at the inside of the curved sheet-conveying route contains hardness less than that of the other roller arranged at the outside of the curved sheet-conveying route.

10. An image-forming system comprising:

an image-forming apparatus that forms an image on a sheet;

a sheet-conveying device including:

a curved sheet-conveying path that is formed by a curved conveying guide, the curved sheet-conveying path being arranged at an outside of a sheet-conveying route on which a sheet is conveyed and the curved conveying guide being arranged at only an outside of the sheet-conveying route in the curved sheet-conveying path; and a sheet-conveying-direction adjusting member that adjusts a sheet-conveying direction to direct a forward end of the sheet to the curved conveying guide, the sheet-conveying-direction adjusting member being arranged at an upper stream side of the curved conveying guide along the sheet-conveying direction; and a sheet-processing apparatus that performs a sheet-processing on the sheet that is delivered or received to or from the image-forming apparatus through the sheet-conveying device;

wherein the sheet-conveying-direction adjusting member includes a pair of rollers that nip the sheet;

one roller of the pair of rollers, said one roller being arranged at an inside of the curved sheet-conveying route, contains a diameter more than that of the other roller thereof, said other roller being arranged at an outside of the curved sheet-conveying route; and said one roller arranged at the inside of the curved sheet-conveying route contains hardness less than that of the other roller arranged at the outside of the curved sheet-conveying route.

11. The sheet-conveying device according to claim 1, wherein said other roller being arranged at an outside of the curved sheet-conveying route is a driving roller that is driven by a motor, and said one roller being arranged at an inside of the curved-sheet conveying route is a driven roller driven by the driving roller.

12. The sheet-conveying device according to claim 1, wherein said one roller being arranged at an inside of the curved-sheet conveying route is a driving roller that is driven by a motor, and said other roller being arranged at an outside of the curved sheet-conveying route is a driven roller that is driven by the driving roller.

* * * * *